US005816956A

United States Patent [19]

Ellis et al.

[11] Patent Number: 5,816,956

[45] Date of Patent: Oct. 6, 1998

[54] NET SUPPORT STRUCTURE

[75] Inventors: John Ellis, Lower Templestowe; Christopher Harms, Paddington, both of Australia

[73] Assignee: XSPORT Development Pty. Ltd., New South Wales, Australia

[21] Appl. No.: 185,958

[22] PCT Filed: Feb. 28, 1992

[86] PCT No.: PCT/AU92/00087

§ 371 Date: Jun. 3, 1994

§ 102(e) Date: Jun. 3, 1994

[87] PCT Pub. No.: WO93/01866

PCT Pub. Date: Feb. 4, 1993

[30] Foreign Application Priority Data

Jul. 19, 1991 [AU] Australia ..... PK7320

[51] Int. Cl.[6] ..... A63B 69/00

[52] U.S. Cl. ..... 473/4.9; 473/492

[58] Field of Search ..... 273/29 B, 29 BB, 273/29 BC, 411; 473/490, 492

[56] References Cited

U.S. PATENT DOCUMENTS

| | | | |
|---|---|---|---|
| 3,195,898 | 7/1965 | Respini | 273/411 |
| 4,010,951 | 3/1977 | Gronlund | 273/29 B |
| 4,274,632 | 6/1981 | Jacobs | 273/29 BC |
| 5,018,746 | 5/1991 | Cardoza | 273/411 |
| 5,176,344 | 1/1993 | Eberhard | 273/29 BB |

FOREIGN PATENT DOCUMENTS 2 485 379 12/1981 France .

*Primary Examiner*—Theatrice Brown
*Attorney, Agent, or Firm*—Hill & Simpson

[57] ABSTRACT

A net support structure is disclosed which provides for easy assembly and disassembly at any location for enabling games such as tennis and volleyball to be played as well as providing a rebound net or safety net for use in other sporting games or for the practice of sporting games. The net support structure includes a plurality of modules (12, 22, 24 and 26) which are joined together by an elastic cord (50) or springs (100) and which when connected together tension the modules to form a net support structure and which can be collapsed by disconnecting the modules and allowing the modules to be folded whilst at the same time keeping the modules joined by the tensioning means. Elbows (30) are provided which form corners and which are permanently or releasably joined by the cord (50). If releasably joined the elbows (30) can be repositioned to alter the configuration of the net support structure.

10 Claims, 4 Drawing Sheets

50
52
69
70
60
62
70
69
52
50
12'
12
14
40
22'
14
30
38
40
24
40
26
40
24
20
34
38
30
32
14
22'
14
40
12'
12

26
24
50
22
30
12
146
148
51
154
152
24
100
22
100
30
12

NET SUPPORT STRUCTURE

This invention relates to a net support structure and in particular to a net support structure for supporting a tennis net, volleyball net a practice or protection net and the like.

Conventional net support for tennis nets, volleyball nets or the like generally comprise posts which are either permanently fixed to the ground or located in sockets in the ground. Both of the conventional structures require the net to be located in a predetermined position by virtue of the fixed sockets into which the posts are inserted and do not allow the net to be easily set up in other environments for use on any suitable playing surface.

The object of this invention is to provide a net support structure which is easily transportable and which can be set up on any suitable playing area.

The invention may be said to reside in a net support structure comprising;

a pair of upright frame members, a cross frame member, at least two joining members for joining the pair of upright members to the cross member, and a tensioning means for joining the upright members and cross member, so that when the uprights and cross frame members are connected by the joining members the upright members and cross member are tensioned to form an erected net support structure and when disconnected from one another whilst remaining joined by the tensioning means to allow the net support structure to be collapsed and stored.

Since the net support comprises upright members and the cross member which are joined by a joining member they can be easily disconnected for transportation and storage and can be set up anywhere and will be self supporting by virtue of the tension applied by the tension means and also with the tension means. Thus, the net can be set up on any suitable playing area without the need of fixed posts or sockets in the ground for receiving posts.

Preferably the upright members and cross member comprises tubular members.

Preferably the joining members comprises a joining elbow having first and second sockets for receiving ends of the upright members and the cross member.

Preferably the joining members includes an additional pair of sockets cojoined in a plane transverse to a plane containing the first and second sockets, for receiving leg members for stably supporting the net support structure on the ground.

Preferably the tensioning means comprises a cord.

Preferably the cord is supported by the tubular members by passing through the tubular members.

In other embodiments the tensioning means could comprise springs interconnecting the upright members and the base member.

Preferably the pair of uprights include a sleeve thereon which is movable relative to the uprights.

Preferably the cross member comprises a plurality of tubular members having fixed sleeves at an end which will form the outer extremity of each when the support structure is assembled so that a plurality of tubular members can be connected together by inserting a free end of one tubular member into the sleeve of another tubular member.

The invention also provides a net support structure comprising:

a plurality of elongate frame modules;

connecting means on said frame modules for allowing the frame modules to be connected end to end to form a net support structure of a desired configuration; and tensioning means supported by the modules for tensioning the modules when the modules are connected together to form an erected net support structure and which join the modules when disconnected from one another so that the modules can be collapsed and stored whilst nevertheless being joined by the tensioning means.

A preferred embodiment of the invention will be described by way of example, with reference to the accompanying drawings in which.

Figure 1:
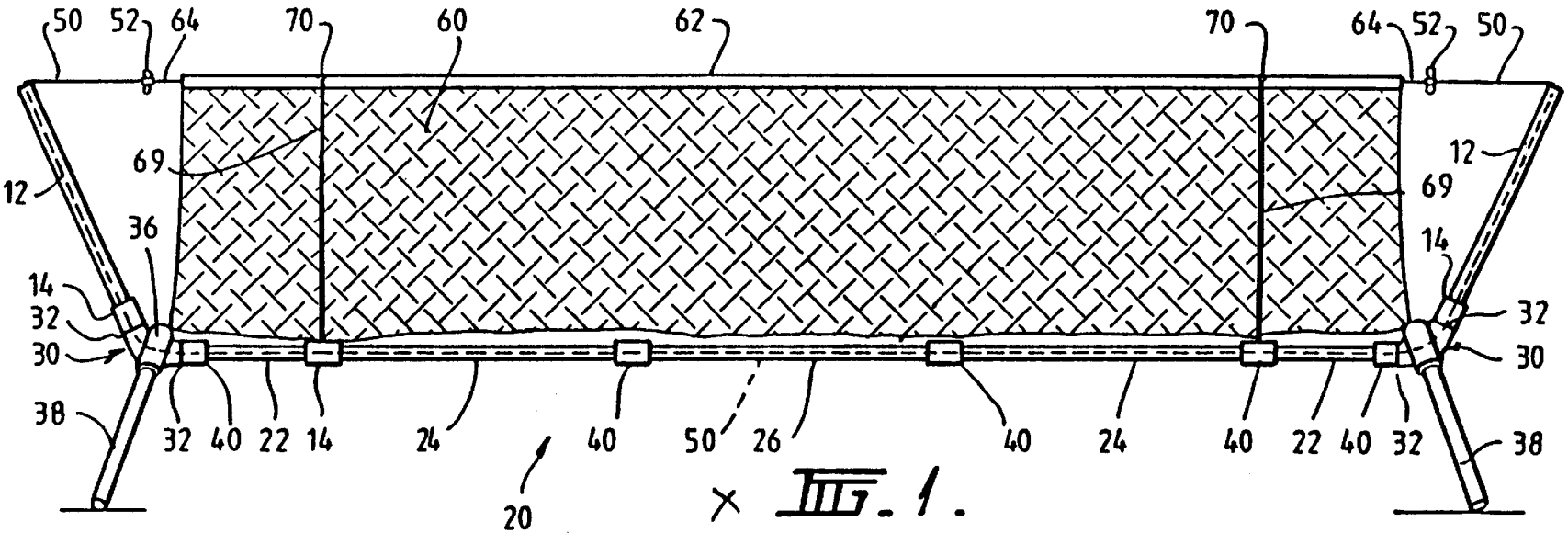
FIG. 1 is a view of a net support structure embodying the invention.

With reference to FIG. 1 the net support structure comprises a pair of uprights 12 which are formed from tubular aluminium. The uprights 12 are provided with sleeves 14 which are movable on the uprights 12 but which are generally retained on the uprights 12. A cross member, which in this embodiment is a base frame member 20, is provided to join the upright members 12 and the base frame member 20 is formed from a plurality of modules 22, 24 and 26. The modules 22, 24 and 26 are also tubular aluminium members.

The uprights 12 are joined to the base member 20 formed from the modules 22, 24 and 26 by joining members 30 which are generally in the form of elbows and which have a pair of sockets 32 and 34. The elbows 30 are also provided with an additional pair of sockets 36 which support leg members 38 for stably supporting the net structure on the ground.

Figure 2:
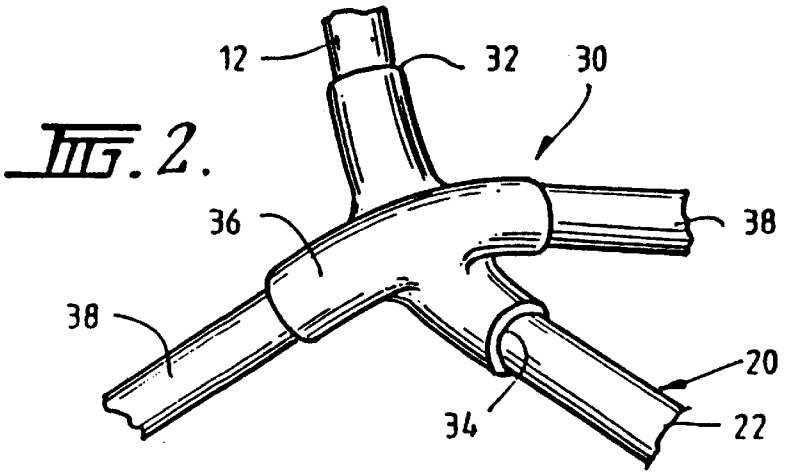
FIG. 2 is a detailed view of a joining member used in the embodiment of FIG. 1.
Figure 3:
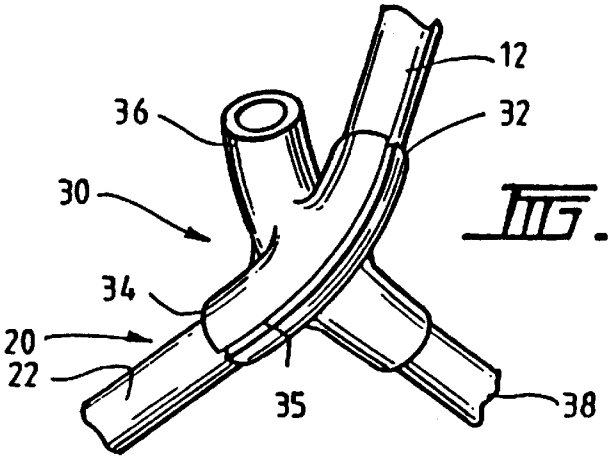
FIG. 3 is a view of the joining member of FIG. 2 from the opposite side.

The elbows 30 are best seen in FIGS. 2 and 3.

The tubular module 26 is provided with sleeves 40 which are permanently fixed to the ends of the module 26. The modules 22 and 24 have a fixed sleeve 40 at the end of the modules which are intended to be the outermost ends of those modules when the modules are connected together. The modules 22 are provided with a movable sleeve 14 similar to the sleeves 14 on uprights 12 and which are movable relative to the modules 22.

The base member 20 is formed by simply sliding the free ends of the tubular modules 24 into the sleeves 40 on module 26. The free ends of the modules 22 are then inserted into sleeves 40 of the modules 24 with the movable sleeves 14 on the modules 22 being moved out of the way to an intermediate position on modules 22 as shown. The sleeves 14 on the modules 22 play no part in this configuration. The sleeves 40 on the modules 22 now slot into sockets 34 on the elbows 30.

An elasticized cord 50 is provided which extends through uprights 12 and the modules which make up base member 20 and is provided with toggles 52 to prevent the ends of the elasticized cord from entering the uprights 12. The toggles 52 may also be used to secure net 60 so that net 60 is suspended between the uprights 12.

Preferably the elasticized cord 50 is passed through the uprights 12 and the members 20 and the toggles 52 are joined in place so that the uprights 12 and modules forming the member 20 are joined together. This generally ties the uprights 12 and modules 22, 24 and 26 together even when the net structure is not erected. When the net structure is not erected the modules are just disconnected from another and from the elbows 30 by slipping the modules 22, 24 and 26 from the respective sleeves and from the elbows so that they can be folded into side by side relationship with the elasticized cord still passing through them and therefore joining them together even in the collapsed state.

As is best shown in FIG. 3 the elbow 30 is provided with a slot 35 which extends along the entire length of the elbow from the end of sockets 32 to the end of socket 34. The slot 35 enables the elasticized cord 50 to enter the elbow 30 when the uprights 12 and frame members 22 are joined with the elbows 30 so that the elasticized cord is accommodated in the elbow 30.

The slot 35 in the elbows 30 enables the elbows to be inserted onto the cord so that the uprights 12 and frame member 22 can easily inserted into the sockets 32 and 34 with the cord extending through the uprights 12 and the sockets 22 and can enable the elbow 30 to be disassembled from the cord when desired to pack up and store or transport the net support structure.

The additional sockets 36 generally form an obtuse angle with the horizontal so that the leg members 38 are splayed outwardly to support the frame member 20 and elbows 30 on or above the ground with the uprights extending upwardly preferably at an angle as shown in FIG. 1 so that the net 60 can be easily suspended between them. The cord 50 is elasticized so that when the net 60 is suspended by the cord 50 it applies tension to the upright 12 and the frame member 20 to tension the structure.

The net 60 is provided with a heading tape 62 through which cord line 64 passer which can be tied onto the toggles 52 to join the net 60 to the elasticized cords 50.

The heading tape 62 is provided with eyelets 70 to which are tied tie cords 69. The tie cords 69 can be used to pull the net 60 downwards to reduce its height and the tie cords 69 can be tied to base member 20 to hold the net in this position.

Figures 4, 6, 7:
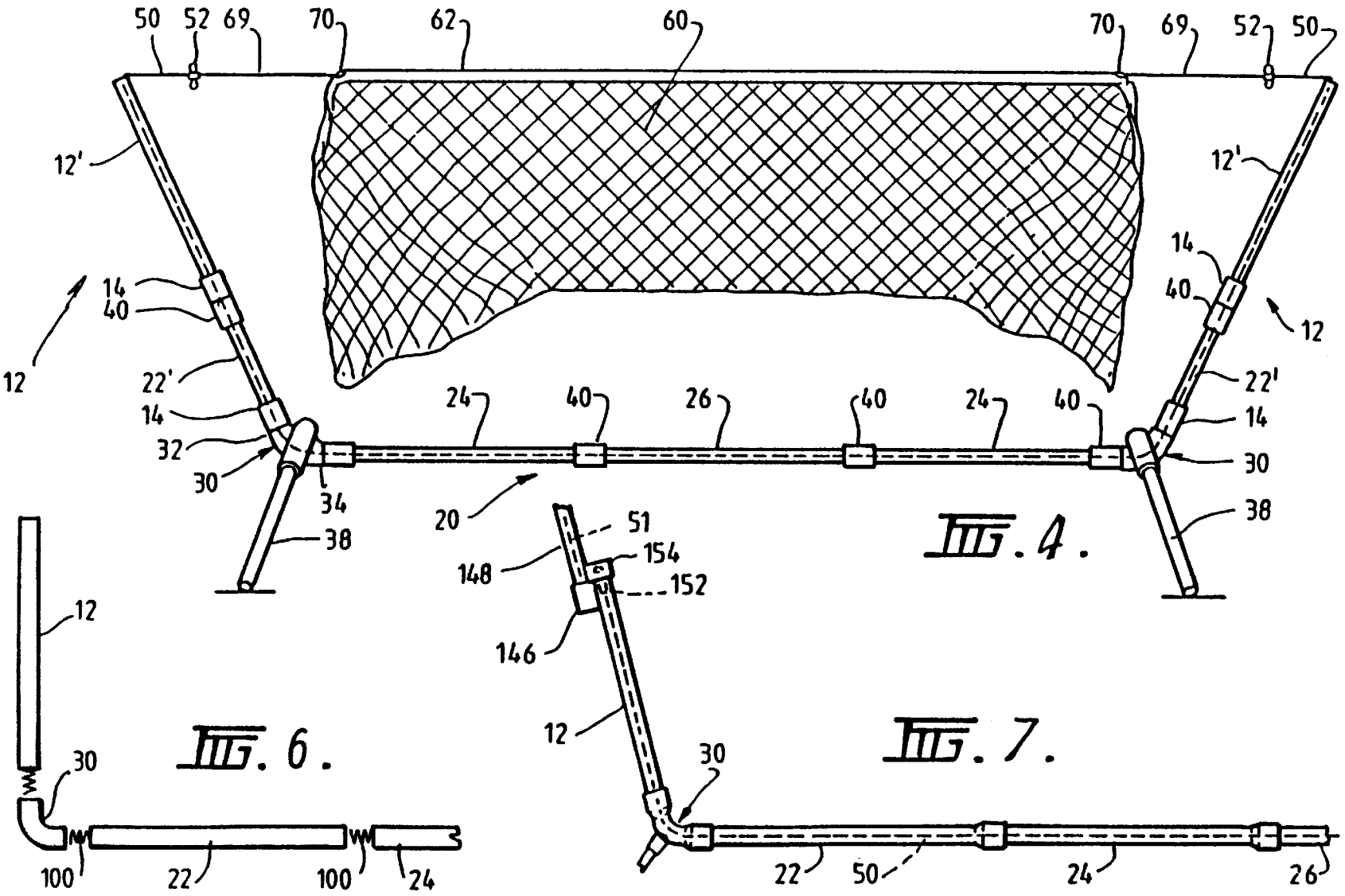
FIG. 4 is a view of a net support structure according to another embodiment of the invention.
FIG. 6 is a view of a further embodiment.
FIG. 7 is a view of a further embodiment.

FIG. 4 shows a second embodiment where the net support structure is intended to support the net 60 at a higher level for playing volleyball, badminton or the like. In this embodiment the uprights 12 are formed by upright members identical to those used in the embodiment of FIG. 1 and which are referenced 12' in FIG. 4 and secondary uprights 22' which are identical to the modular members 22 used in the horizontal frame member 20 in FIG. 1. Thus, the elbows 30 are simply located between the modules 24 and modules 22 instead of between the uprights 12 and modules 22. In this embodiment the movable sleeve 14 on the upright member 12 is simply slid up along the upright 12 to expose the end of the upright 12' so that the end of the upright 12' can be inserted into the fixed sleeve 40 on the end of the frame member 22'. The movable sleeve 14 on the frame member 22' simply falls under the influence of gravity to be retained by socket 32 of elbow 30.

The movable sleeve 14 which is on the uprights 12' simply falls under the influence of gravity and rests on the sleeve 40 which is attached to the upright 22' and in which the end of the tubular upright frame member 12' is received.

The base frame member 20 is formed from the modular members 24 and 26 which are described with reference to FIG. 1. Thus, the distance between the uprights 12 is reduced compared to that in FIG. 1 but the height of the net is raised so that the net is now suitable for volleyball.

To secure the net the tie cords 69 tied to the eyelets 70 in the heading tape 62 are tied onto the toggles 52 to secure the net and shorten the length of the net. The parts of the net beyond eyelets 70 simply fall free.

Although the uprights 12 and frame member 20 are shown straight in the drawings they tend to bow slightly when the net 60 is suspended because of tension applied by the cord 50.

In alternative embodiments instead of connecting the uprights 12 and modules 22, 24 and 26 together by sleeves 40 the modules 22, 24, 26 and the uprights 12 could be joined by making adjacent modules and uprights of slightly different diameter tubular material so that the end of one module is telescopically received into the end of the adjacent module. The larger diameter module could be provided with rivets, depressions or the like to act as an abutment to limit the amount of insertion of the smaller diameter module.

In another embodiment the uprights 12 and modules 22, 24 and 26 could be of the same diameter and ends could be swayed to provide an enlarged diameter portion or a small diameter portion for telescopically joining the modules.

In a further embodiment instead of utilizing the toggle 52 to prevent the cord 50 from being drawn out of the uprights 12 and modules 22, 24 and 26 the cord 50 could be joined to the upper end of the uprights 12 by means of an insert (which will be described with reference to FIG. 7) which is received and retained in the end of the uprights 12 and which has a hole through which the cord 50 passes and is tied off. An end cap (to be described with reference to FIG. 7) could be located over the uprights 12 to cover the insert. In this embodiment instead of using the toggle 52 to secure the net, the net could be provided with a hook or clasp for securing it to the uprights 12 or a fixture connected to the uprights or the net could be provided with a sleeve which is merely slipped over the uprights 12 in order to locate the net in place.

In the embodiments described above, the elbows 30 are provided with the slots 35 so that the elbows can be completely removed from the elasticated cord and can be repositioned between any of the uprights 12, and modules 22, 24 and 26. In an alternative embodiment the slot 35 in the elbows 30 could be omitted so that the elasticated cord 50 passes through the elbows 30 and the elbows 30 are located only in one position and remain in that position. In this embodiment the net structure would be a fixed structure and a number of configurations would not normally be available. Thus, the net would be a permanent tennis net with the elbows 30 fixed between the uprights 12 and modules 22, or a volleyball net with the elbows 30 fixed between the modules 22' (FIG. 4) and the modules 24. However, even with the elbows 30 not provided with slots 35 and permanently fixed on the elasticated cord 50 in a single position it is still possible in some instances to alter the configuration of the net structure to allow different games to be played. For example, in the case of the volleyball net shown in FIG. 4, even in the elbow 30 is fixed in place it would be possible to disconnect the uprights 12' from the modules 22' and fold the uprights 12' downwardly so that they are arranged adjacent to the modules 22'. The uprights 12' could be fixed to the modules 22' by velcro (trade mark) fastener strips or the like and the net could therefore extend between the top of the modules 22' to provide a lower net for playing tennis or the like.

Figure 5:
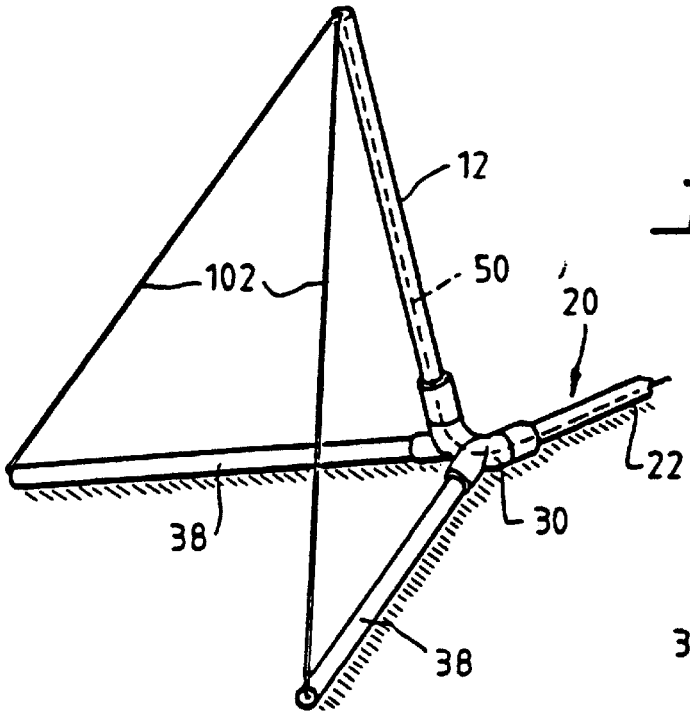
FIG. 5 is a view of a further embodiment.

FIG. 5 shows an embodiment which is similar to that of FIGS. 1 and 4 expect that additional support members 102 are provided between upright 12 and the ends of legs 38. The additional supports 102 could be tubular members, elasticated cords or the like. In this embodiment of the invention the legs 38 are coplanar with the base member 20 so that the base member 20, the elbow 30 and the legs 38 sit flat on the ground. The additional support members 102 securely tie the upright 12 to the legs 38 to provided added strength and reinforcement for the net. If the additional supports members 102 are elasticated cords eyes or the like could be provided on the legs 38 and the uprights 12 for receiving the ends of the cords. If the supports are in the form of tubular members then sockets or elbows could be provided on the legs 38 and the upright 12 in order to receive the ends of the additional supports 102.

With reference to FIG. 6 a different method of joining the modules 22, 24, 26, elbow 30 and upright 12 is shown. In this embodiment of the invention instead of using the elasticated cord 50 springs are connected between the modules 22, 24 and 26, the elbow 30 and the uprights 12. The modules 22, 24, elbow 30 and upright 12 are shown separated for the ease of illustration. In order to erect the net the springs 100 simply pull the ends of the modules 22, 24, elbow 30 and upright 12 together so that they abut the adjacent module, elbow or upright as the case may be, to securely hold the modules, elbow and upright together. The springs 100 therefore tension the modules 22, 24, elbow 30 and upright 12 in the same manner as the cord in the earlier embodiments. In order to collapse the system the modules 22, 24, elbow 30 and upright 12 are simply pulled apart to stretch the springs 100 as shown in FIG. 6 and the modules are folded into a position adjacent one another as in the earlier embodiment for storage.

In the embodiment described with reference to FIGS. 1, 4 and 5, the legs 38 are not joined by the cord 50 or any other members to the remaining components of the net support structure. It would be possible in those embodiments to join the legs 38 by means of springs (not shown) to the elbows 30 so that they are always joined to the structure and can be connected by simply allowing the springs to pull the legs 38 into the desired supporting position and collapse by stretching the spring and allowing the leg 38 to be folded into the collapsed position beside the base member 20 or upright 12. In yet a further embodiment instead of using springs to join the legs 38 to the elbows 30 separate elasticated cords (not shown) could be used to perform this function.

FIG. 7 shows yet a further embodiment of the invention in which the upright 12 includes a socket 146 for receiving additional upright member 148. Elasticated cord 50 is connected to insert 152 located in the uprights 12 by passing the elasticated cord through a hole (not shown) in the insert 152 and tying the cord off behind the insert 152. An end cap 154 can be located over the upright 12 to cover the insert 152 and the tied off cord 50. Elasticated cord 50 joins the upright 12, elbow 30, modules 22, 24 etc. in the same manner as in the earlier embodiments and tensions them when the modules and uprights are connected together. A net such as a tennis can be coupled to the upright 12 by a hook or other fastener (not shown) which engages an eye or other fastener (not shown) on the upright 12. If it is desired to extend the height of the net to play volleyball or the like the upright 148 is located in the sleeve 146 to support the net. Depending upon the height which is desired for the net and the size of the uprights 148 a number of uprights 148 could be utilized. Preferably those uprights are joined by an elasticated cord 51 which is secured to the lower end of the bottom upright 148 and passes through all of the uprights 148 and is connected to the top of the upper upright 148 for joining the uprights 148 and tensioning them when in the erected state.

The embodiment of FIG. 7 also shows a method of connecting the upright 12, elbow 30 and modules 22, 24 etc. by providing enlarged diameter swaged ends on the elbows 30, modules 22, 24 etc.

FIGS. 8 to 12 show some additional configurations which can be produced according to preferred embodiments of this invention. In each of the configurations shown in FIGS. 8 to 12 the modules 110 are the same as the modules 22, 24, 26 and upright 12 previously described and they can be joined and tensioned by means of an elasticated cord similar to the cord 50 or by means of the springs 100 between the modules 110. The modules 110 are joined by any one of the methods previously described (i.e. by sleeves 40, small and large diameter modules, modules having small and and large diameter ends etc.). Elbows (not shown in FIGS. 7, 9, 10 and 11) are provided at all right angled corners. Depending on the nature of the net support structure the elbows can be provided with additional sockets for legs supports or the additional sockets can be omitted if additional legs are not required.

Figure 8:
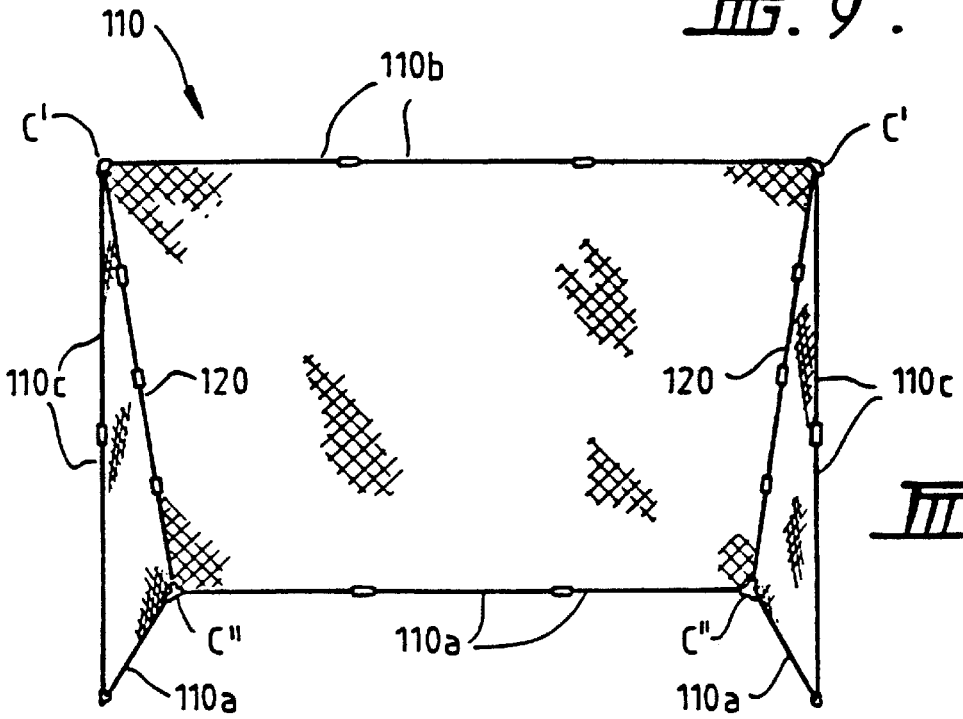
FIGS. 8 and 12 are diagrams showing various net support structure configurations which can be formed according to embodiments of the invention.

FIG. 8 shows a net support structure for supporting a soccer net. The structure includes base modules 110*a* and upper modules 110*b* (which comprise cross members) and upright modules 110*c*. In the preferred embodiment of the invention the elbows at the corners (not shown) could be provided with slots similar to the slots 35 so that the elbows can be removed and relocated between any of the modules 110 to change the dimensions and shape of the net. The configuration shown in FIG. 8 is best suited for soccer or water polo but if the configuration is turned on its side it could be used as a barrier net for other ball games or, indeed, the configuration of the net could be completely altered by merely relocating the elbows between any of the desired modules to form right angled corners where desired in order to provide a net support structure of any desired shape.

The embodiment shown in FIG. 8 can also be used to form a cage by the use of two structure of the type shown in FIG. 8 and by turning the structures upside down and locating them side by side so that they effectively form a cage or race in which cricket, baseball or the like can be practised.

Figure 9:
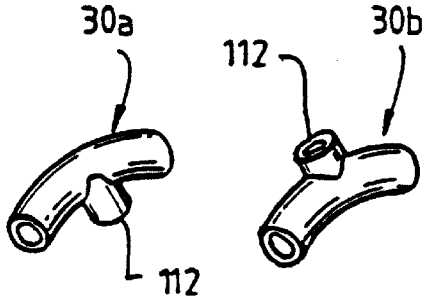

FIG. 9 shows preferred elbows 30*a* and 30*b* which may be incorporated if it is desired to use additional modules 120 to provide additional support for the net structure. Elbows 30*a* would be arranged at the corners C' and elbows 30*b* would be arranged at the corners C". The elbows 30*a* and 30*b* are each provided with sockets 112 so that a tubular module 120 can be inserted into the sockets 112 to join the elbows and provide additional reinforcement for the net structure. Once again in the preferred embodiment the additional support modules 120 could be completely removed from the net structure or could be joined to the elbows 30*a* and 30*b* by springs or elasticated cords to join those modules to the other modules forming the net support structure.

Figures 10, 11, 12:
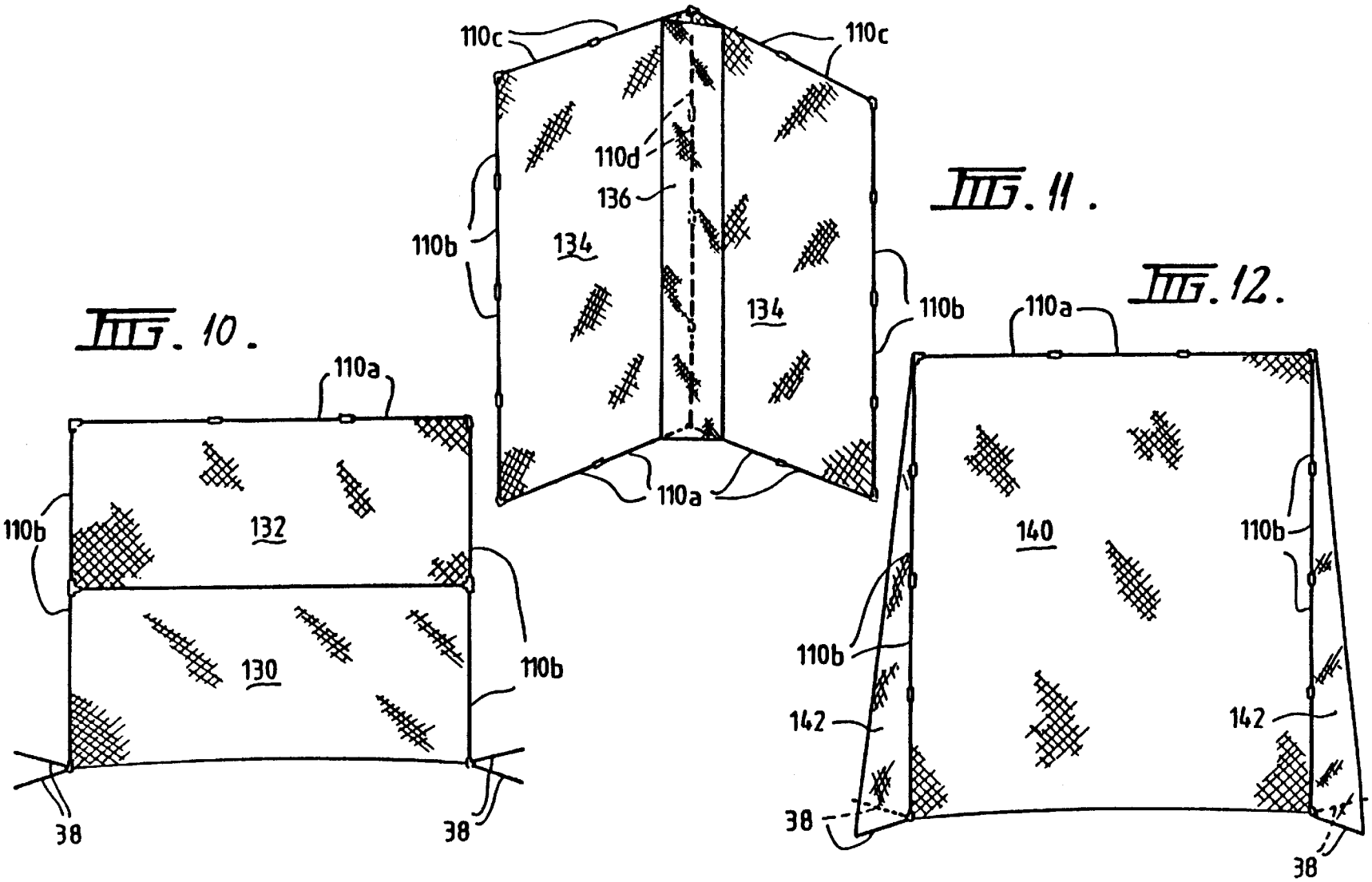

FIG. 10 shows a rebound net formed from modules 110*a* which form an upper cross member and modules 100*b* which form uprights. This module can be used to act as a rebound net for practising ball games such as golf, tennis and the like. In this embodiment the net can be formed from two parts 130 and 132. The net 130 can be a generally loose net similar to a tennis net so that when a ball hits the net it drops without rebounding. The net 132 could be a taut net to act as a rebound net so that if the ball hits that net it rebounds into play. In this manner a player can practise tennis by hitting the ball towards the net with a view to hitting the rebound net 132 to obtain a rebound and to continue striking the ball to practise tennis strokes. If the ball hits the lower net 130 it drops dead in a normal fashion that occurs when a ball hits a conventional tennis net. This structure is supported on legs 38 which are connected to elbows similar to those FIGS. 2 and 3.

In the embodiment of FIG. 10 the upright modules 110*b* can be joined by a pivot hinge so that the upper two modules

110*b* can be folded down adjacent to the lower modules 100*b* so that the rebound net 132 is moved out of the way so that the net support structure can be used as a normal tennis net.

FIG. 11 shows a golf practice net which is generally of L-shape configuration formed of base modules 110*a*, uprights 112 and upper members 110*c*, mid-support members 110*d* are also provided. The net support structure supports a main net 134 and a mid-support protection net 136 for preventing a golf ball from striking the modules 110*b* and rebounding towards the player.

FIG. 12 shows a net which can be used to divided a cricket pitch so that cricket can be practised with bowlers operating from the ends of the pitch at the same time. In this embodiment cross members 110*a* are provided and uprights 110*b*. The uprights 110*b* are supported by leg members 38. A net 140 is suspended by the net support structure and side nets 142 are arranged between the leg members 38 and the upright members 110*b* to provide additional protection.

Nets of the type shown in FIGS. 10, 11 and 12 can be used as backstops, for other ball games such as baseball, softball and the like.

The nets which are connected to the net support structure shown in FIGS. 8 to 12 can be joined to the modules which form the net support structure by hooks, ties or any suitable fasteners such as velcro (trade mark) fasteners. Alternatively, an elasticated cord could be threaded through the net and wrapped around the modules which make up the net support structure in order to secure the net in place. When the net support structures are collapsed the net can be removed from the structure or can be left attached to the structure and simply folded up with the modules for storage.

Since modifications within the spirit and scope of the invention may readily be effected by persons skilled within the art, it is to be understood that this invention is not limited to the particular embodiments described by way of example hereinabove.

We claim:

1. A net support structure, comprising:

a pair of tubular upright members;

a tubular cross frame member;

at least two joining members for adjacently joining respective ends of the upright members to respective ends of the cross frame member;

a single elastic tensioning cord extending interiorly through the upright members, joining members and cross frame member;

wherein when the tensioning cord is in tension, the upright members, the joining members and the cross frame member are biased by the tensioning cord to be compressed against each other to form an erected net support structure, and when disconnected from one another, the upright members and the cross frame member remain joined by the tensioning cord in a slack condition to maintain the upright members and cross frame member together and allow the net support structure to be collapsed and stored; and wherein the net support structure supports a net over which a ball is to be hit, and the tensioning cord has free ends projecting from the upright members, and further including a net for connection to the free ends of the tensioning cord for placing the tensioning cord in tension and also tensioning the net in the net support structure.

2. The net support structure according to claim 1, wherein the net support structure supports a net from one of a tennis and a volleyball net.

3. The net support structure according to claim 1, wherein the joining members include an additional pair of sockets conjoined in a plane transverse to a plane containing the first and second sockets, for receiving leg members for stably supporting the net support structure on the ground.

4. The net support structure according to claim 1, wherein the upright members and the cross member comprise tubular members.

5. The net support structure according to claim 1, wherein the joining members comprise a joining elbow having first and second sockets for receiving ends of the upright members and the cross member.

6. The net support structure according to claim 1, wherein the cross member and upright members are connected together by telescopically engaging respective joining members.

7. The net support structure according to claim 1, wherein the cross frame member includes a plurality of modules which are connected together in order to form the cross frame member, said tensioning cord joining the modules so that when the modules are connected together they are put into compression by the tension cord.

8. The net support structure according to claim 1, wherein the joining members are releasably connectable to said tensioning cord so that they can be separated from the tensioning cord and repositioned at a variety of locations to alter the height of the upright frame members and length of the cross frame member to change the height and length of the net support structure.

9. The net support structure according to claim 8, wherein the joining members comprise elbows and slots are provided in the elbows for receiving the tensioning means in order to releasably join the joining members to the tensioning cord.

10. The net support structure according to claim 1, wherein the joining members are in a fixed position and are permanently joined by the tensioning cord between the upright frame members and the cross frame member.

* * * * *